United States Patent [19]

Abrams

[11] Patent Number: 4,458,820

[45] Date of Patent: Jul. 10, 1984

[54] TAMPER-INDICATING ARRANGEMENT FOR A CONTAINER

[76] Inventor: Martin Abrams, 201 E. Chestnut, Chicago, Ill. 60611

[21] Appl. No.: 465,915

[22] Filed: Feb. 14, 1983

[51] Int. Cl.[3] ..... B65D 55/02

[52] U.S. Cl. ..... 215/230; 215/250

[58] Field of Search ..... 215/230, 252, 253, 250

[56] References Cited

U.S. PATENT DOCUMENTS

| | | | |
|---|---|---|---|
| 575,248 | 1/1897 | Koehler | 215/250 |
| 2,939,597 | 6/1960 | Greene | 215/230 |

*Primary Examiner*—Donald F. Norton

*Attorney, Agent, or Firm*—Dressler, Goldsmith, Shore, Sutker & Milnamow, Ltd.

[57] ABSTRACT

A tamper-indicating arrangement for a container is disclosed which functions to provide a clear visual indication that the container has been opened. The arrangement includes a closure which is adapted to be fitted to the container, and further includes first and second coacting means for respectively retaining the closure on the container in distinct first and second positions with respect to the container. In this way, the closure can be initially applied to the container in its first position, and can only be reapplied and retained on the container in a reoriented second position. Suitable indicia are preferably provided on the closure and the container for visually indicating reorientation of the closure from its first position to its second position.

19 Claims, 17 Drawing Figures

TAMPER-INDICATING ARRANGEMENT FOR A CONTAINER

TECHNICAL FIELD

The present invention relates generally to tamper-indicating closure arrangements for a container, and more particularly to a tamper-indicating arrangement which permits a closure to be initially fitted to a container in a first position with respect thereto, and subsequently reapplied to the container in a reoriented second position.

BACKGROUND OF THE INVENTION

It is extremely desirable to provide tamper-indicating arrangements for containers such as for food products and drugs. Such arrangements should provide a clear verification for a purchaser that the product being purchased is in its original, unopened container.

While the desirability of tamper-indicating arrangements is well-recognized, it is also important that such arrangements be straightforward in construction for economical manufacture, as well as reliable for indicating tampering. Additionally, such arrangements should not be unduly difficult to operate when access to the contents of the container is desired. Such arrangements should also permit a closure to be easily reapplied to a container after it is initially opened.

The present tamper-indicating arrangement meets these desired goals with a straightforward and highly effective tamper-indicating construction. Notably, the present invention is readily adaptable for retrofit to existing container constructions.

SUMMARY OF THE INVENTION

The present tamper-indicating arrangement contemplates a construction which permits a closure to be initially applied to a container and retained thereon in a first position, and subsequently reapplied to the container and retained thereon in a second, reoriented position. Suitable indicia preferably provided on the closure and the container provide a clear visual indication of the relative position of the closure with respect to the container, thus permitting a purchaser to easily verify that the container is unopened.

The present tamper-indicating arrangement includes a closure adapted to close the open mouth defined by the neck portion of a container. A first coacting arrangement is provided on the closure and the container for permitting the closure to be applied thereto and retained in place in a first position with respect to the container. In the preferred embodiment, this first coacting arrangement includes one or more first projections provided on one of the closure and container, and one or more first openings on the other of the container and closure. The first openings are adapted to respectively receive the first projections, preferably by generally axial movement of the closure onto the container, such as by a press-fit, for retention of the closure on the container in a first position with respect thereto.

In the preferred embodiment, the first projections are fracturable, such as by manual relative rotation of the closure and the container. These first projections are intended to fracture when the closure is first removed from the container, and function such that the closure can no longer be retained in its first position with respect to the container after it is removed therefrom.

The present tamper-indicating arrangement further includes a second coacting arrangement on the closure and the container for retaining the closure thereon in a second position which is reoriented from the first position. The second coacting arrangement preferably comprises one or more second projections on one of the closure and the container, and one or more second openings on the other of the closure and container. The second openings are adapted to respectively receive the second projections to permit the closure to be reapplied to the container in its second reoriented position. In the preferred embodiment, the second openings comprise open-ended slots which are adapted to receive the second projections by generally axial movement of the closure onto the container, followed by relative rotation therebetween.

The tamper-indicating arrangement preferably includes means for visually indicating reorientation of the closure from its first position to its second position with respect to the container. In the illustrative embodiments, the indicating means are shown as arrow-like markings respectively provided on the closure and the container. This arrangement is illustrated for clarity of the following detailed description. However, it is presently contemplated that the reorientation indicating means of the present invention can be provided in many different ways, such as by suitable coloring of the closure and the container, suitable labels applied thereto, or any number of other like markings. The preferred indicating arrangement will in part depend upon the type of container for which the present arrangement is used.

In three of the illustrated embodiments, the components of the first and second coacting arrangements which are provided on the container are illustrated as integrally formed therewith. However, it will be recognized that these components can easily be provided by an annular adapter adapted to fit generally about the mouth of an existing container. This flexibility permits the present invention to be readily adapted for use with existing containers, with such an annular adapter member shown in another illustrated embodiment of the present invention.

Numerous other features and advantages of the present invention will become readily apparent from the following detailed description of the invention and the embodiments thereof, from the claims and from the accompanying drawings.

DETAILED DESCRIPTION

Figure 1:
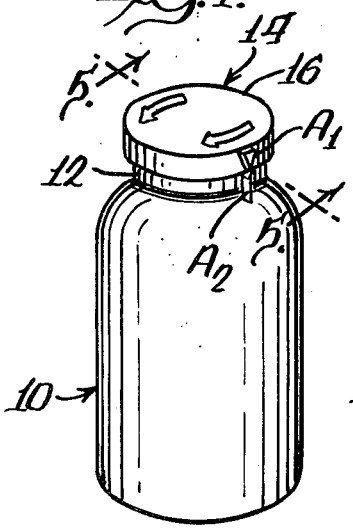
FIG. 1 is a perspective view of a closure and a container embodying the present tamper-indicating arrangement, with the closure retained on the container in a first, unopened position.

While the present invention is susceptible of embodiment in different forms, there is shown in the drawings and will hereinafter be described various embodiments, with the understanding that the present disclosure is to be considered as an exemplification of the invention and is not intended to limit the invention to specific embodiments illustrated.

Referring now to FIGS. 1-5, therein is illustrated the tamper-indicating arrangement embodying the present invention. As will become apparent from the following description, the present invention can be readily adapted for use with existing containers, or can be embodied as a closure and a container particularly suited for use with each other.

The present invention is illustrated in association with a container 10 including a neck portion 12 defining an open mouth. It is contemplated that container 10 be suited for packaging and sale of products for which a tamper-indicating arrangement is desirable, such as food, drugs, beverages, and the like.

The present invention includes a closure 14 which is adapted to close the open mouth of container 10. In this embodiment, closure 14 includes a top wall portion 16, and an annular, skirt portion 18 depending from top wall portion 16. Depending upon the contents of container 10, closure 14 may include a suitable sealing arrangement such as a sealing liner or the like. Closure 14 can be formed from suitable plastic material, and can also be fabricated from metal, which can be desirable for some applications.

In accordance with the present invention, a first coacting arrangement is provided on closure 14 and container 10 for retaining the closure on the container in a first position with respect thereto when the closure is initially applied to the container, such as during the packaging of the contents of the container. To this end, first locking projections are provided on one of the closure 14 and container 10, with the first locking projections being receivable within first openings defined by the other of the closure and the container.

Figure 6:
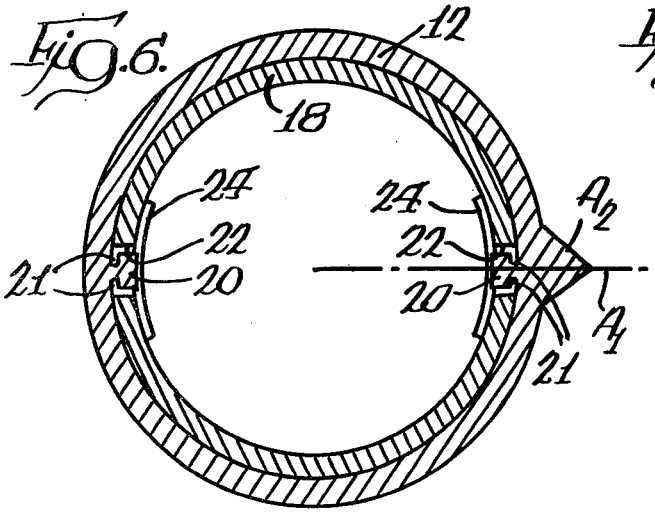
FIG. 6 is a cross-sectional view taken generally along lines 6—6 of FIG. 5.

Thus, the neck portion 12 of container 10 includes one or more first locking projections 20 (two being illustrated) with first locking projections 20 projecting inwardly of the neck portion 12 of container 10. As will be described, first projections 20 are frangible, and are intended to fracture, break, or be otherwise permanently deformed attendant to the initial removal of closure 14 from container 10. Thus, projections 10 preferably comprise plastic material, and are preferably dimensioned to result in their fracture attendant to manual removal of closure 14 from container 10. If desired, projections 20 can be scored or otherwise preferentially weakened, such as by scores 21 as shown in FIG. 6.

First locking projections 20 are adapted to be respectively received within one or more first openings 22 defined by skirt portion 18 of closure 14. First openings 22 are preferably close-sided as shown, and can either extend through skirt portion 18 (as illustrated), or be provided by indentations in the skirt portion. First openings 22 coact with first locking projections 20 to retain closure 14 on container 10 in a first position with respect thereto. In the preferred embodiment, projections 20 are receivable within openings 22 by generally axial movement of closure 14 onto container 10, in the nature of a press-fit. This facilitates convenient initial application of the closure to the container during the packaging process.

Figure 5:
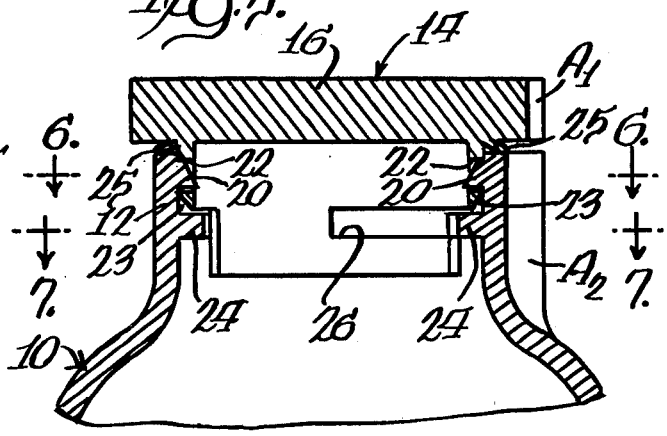
FIG. 5 is a cross-sectional view taken generally along lines 5—5 of FIG. 1.

Cam means are preferably provided on at least one of the closure and the container to facilitate correct positioning of projections 20 in openings 22 during initial application of the closure to the container. As best shown in FIG. 5, the preferred cam means can be provided by suitably inclining or angling the inwardly facing surface of projections 20 and/or by angling or inclining the portion of skirt portion 18 which engages projections 20 during closure application, as shown at 23. If desired, projections 20 can be configured to deflect downwardly during initial application of closure 14 to container 10, with the projections exhibiting sufficient resilience and strength to prevent them from deflecting upwardly in a manner which would permit closure 14 to be removed without fracture or like permanent deformation of the projections 20.

In order to provide a purchaser with a clear indication that container 10 is unopened, suitable indicia are preferably provided on container 10 and closure 14 to afford a visual indication that the closure is in its first, unopened position on the container. Any number of suitable indicia can be provided for this purpose. In the illustrated embodiments, an arrow-like projection $A_1$ is shown provided on closure 14, with a similar arrow $A_2$ being provided on container 14. When closure 14 is in its first position with respect to container 10, arrows $A_1$ and $A_2$ are illustrated as being in alignment. While arrows such as $A_1$ and $A_2$ can be provided for visually indicating reorientation of closure 14 with respect to container 10, and have been shown for clarity of explanation, it is presently contemplated that suitable color coding labels, or other like markings be provided on the closure and the container for visually indicating the position of the closure on the container.

To further provide a visual indication that container 10 has not been opened, biasing means can be provided on one of the container 10 and the closure 14 for biasing the closure from the container. In this embodiment, such biasing means are provided by one or more resiliently flexible biasing tabs 25 on closure 14 which are adapted to engage container 10. When closure 14 is initially applied to container 12, the closure is held in a fully seated position on the container in opposition to biasing tabs 25 by the coaction of first locking projections 20 with first openings 22, as shown in FIG. 5. After initial opening of the container by fracture of projections 20, the closure can no longer be retained in its first position on the container, with biasing tabs 25 acting to tilt or "prop-up" the closure on the container in a visually discernible manner. Thus, after projections 20 are fractured, biasing tabs 25 prevent closure 14 from fully seating on the container in the first postion of the closure, and act to visually space the closure from the container.

In accordance with the present invention, a second coacting arrangement is provided on closure 14 and container 10 for retaining the closure on the container in a second position with respect thereto when the closure is subsequently reapplied to the container after its initial removal. While various arrangements can be provided for this purpose, it is presently contemplated that one or more second locking projections be provided on one of the closure and the container, with one or more second openings provided on the other of the closure and the container for receiving the second projections, and for coacting therewith to retain the closure on the container in a second position distinct from the first position.

Thus, in this embodiment, second locking projections 24 are provided on the inwardly facing surface of neck portion 12 of container 10. The second locking projections 24 are adapted to be received within second openings 26 defined by skirt portion 18 of closure 14, with the second openings comprising open-ended slots as shown. Second openings 26 are open-ended in the sense that they open downwardly of skirt portion 18 for receiving second projections 24. While illustrated as extending through skirt portion 18, openings 26 can be in the nature of indentations or grooves. Second locking projections 24 cooperate with second openings 26 by moving closure 14 generally axially onto container 10 (in opposition to biasing tabs 25, if provided), and then relatively rotating the closure and the container so that projections 24 are positioned at the closed end of openings 26, preferably in the nature of a bayonet-type fit.

FIGS. 6–10 illustrate use of this first embodiment of the present tamper-indicating arrangement. In these figures, the radially extending phantom line indicates the relative position of arrow $A_1$ on closure 14.

Figure 7:
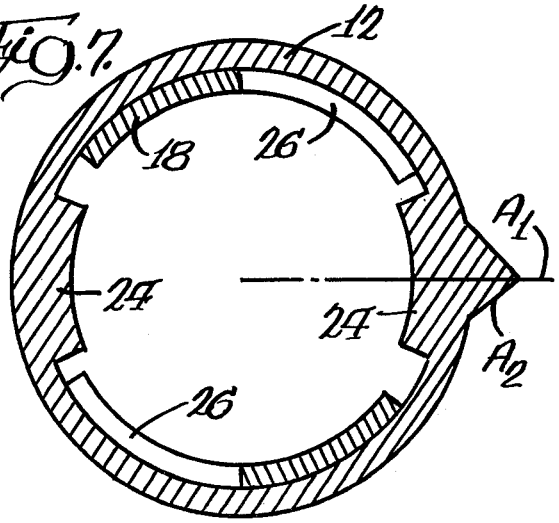
FIG. 7 is a cross-sectional view taken generally along lines 7—7 of FIG. 5.

FIGS. 6 and 7 illustrate closure 14 on container 10 after the closure has been initially applied to the container, preferably by the above-described press-fitting. In this first position of closure 14 (note alignment of arrow $A_1$ and arrow $A_2$) first locking projections 20 are disposed within first openings 22 in skirt portion 18, with the projections and openings cooperating to securely retain closure 14 on the container. FIG. 7 illustrates the disposition of the second locking projections 24 generally within the downwardly open portion of second openings 26 in skirt portion 18. When the present invention is configured as illustrated in these figures, second openings 26 and second projections 24 do not cooperate to retain the closure on the container in the first position of the closure thereon.

Figure 8:
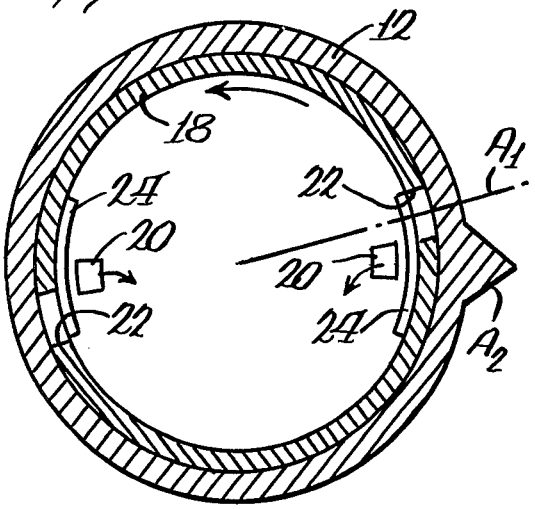
FIG. 8 is a view similar to FIG. 6 illustrating the function of the present tamper-indicating arrangement when the container is initially opened.
Figure 9:
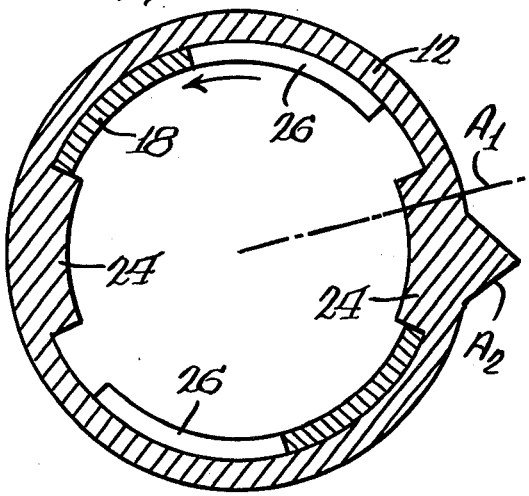
FIGS. 9 and 10 are views similar to FIG. 7 illustrating functioning of the present tamper-indicating arrangement when the closure is reapplied to the container.

FIGS. 8 and 9 illustrate the action of the present tamper-indicating arrangement when closure 14 is first removed from container 10. As noted, first locking projections 20 are intended to fracture, such as by shearing, preferably by manual relative rotation of closure 14 with respect to container 10. If desired, the portion of skirt portion 18 which defines first openings 22 and which bears against and fractures projections 20 during rotation of the closure can be shaped to provide a cutting edge for more efficient shearing of projections 20. The desirability of providing such a cutting edge and/or scores such as 21 (FIG. 6) will depend upon the materials and dimensions of the coacting elements of the present tamper-indicating arrangement. FIG. 9 illustrates the preferred relative spacing of second locking projections 24 with respect to second openings 26 which permits relative rotation of closure 14 and container 12 for fracture of projections 20 without interference from locking projections 24. Notably, after closure 14 is initially removed from container 10 and first locking projections 20 fracture, closure 14 can no longer be retained in its first position on container 10. The provision of biasing tabs 25 prevents closure 14 from fully seating on container 10 in its first position after projections 20 fracture, thus providing a clear visual indication of opening.

Figure 2:
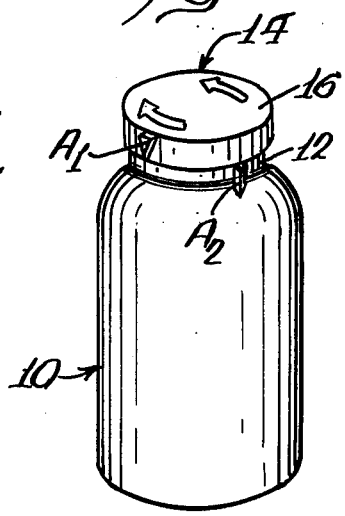
FIG. 2 is a perspective view of the closure and container shown in FIG. 1 illustrating the closure retained on the container in a second position reoriented from the first position.
Figure 3:
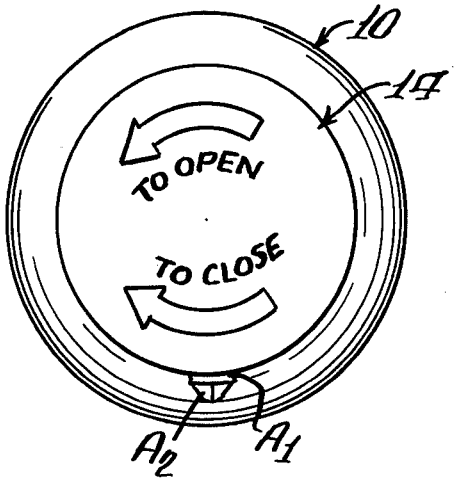
FIG. 3 is a top plan view of the closure and container illustrated in FIG. 1.
Figure 4:
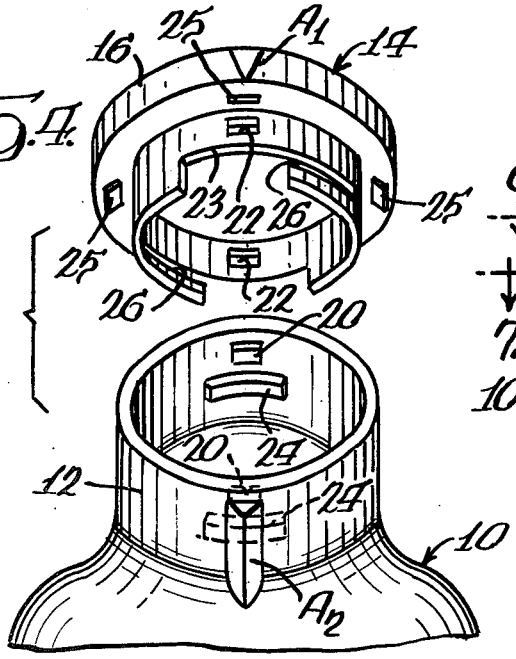
FIG. 4 is an enlarged, partial perspective view of the closure and container of FIG. 1 shown before initial application of the closure to the container.
Figure 10:
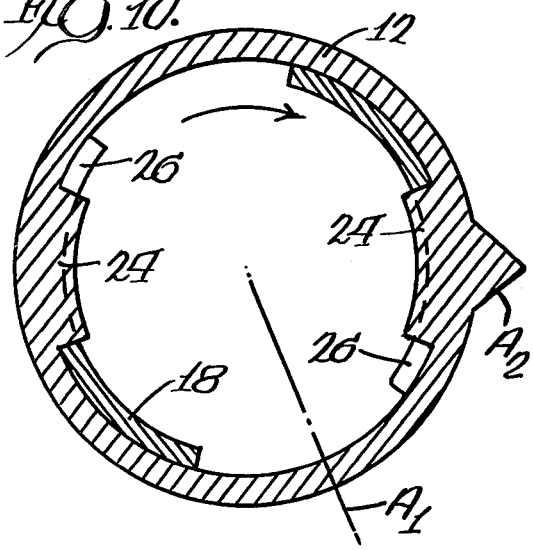

Referring now to FIG. 10, reapplication of closure 14 to container 12 is shown, with the cooperation of second locking projections 24 and second openings 26 being illustrated. When closure 14 is reapplied to container 12 by generally axial movement thereon, followed by relative rotation, projections 24 are received within openings 26 for securely retaining closure 14 on container 10 in its second, reoriented position with respect to the container. FIG. 2 illustrates closure 14 in its second position on container 10, and as is evident from this figure as well as from FIG. 10, the misalignment of arrows $A_1$ and $A_2$ when closure 14 is in its second position on container 10 provides a clear visual indication that the closure has been removed and reapplied to the container.

For some applications of the present invention, it can be desirable to retrofit the invention to existing containers. While the above-described embodiment has been illustrated with the components of the first and second coacting arrangements on the container 14 (i.e., projections 20 and 24) as integrally formed therewith, it will be recognized that the present invention can be embodied with a generally annular member adapted to fit generally about the open mouth of the container on neck portion 12. Such an alternate embodiment is illustrated in FIGS. 11 and 12.

Figure 11:
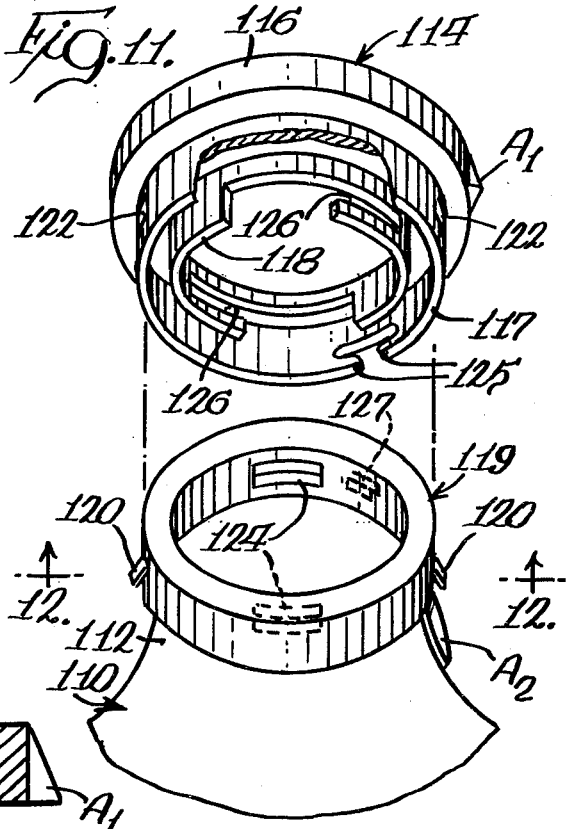
FIG. 11 is a perspective view of an alternate embodiment of the present tamper-indicating arrangement illustrating a closure and an associated container before initial application of closure to the container.
Figure 12:
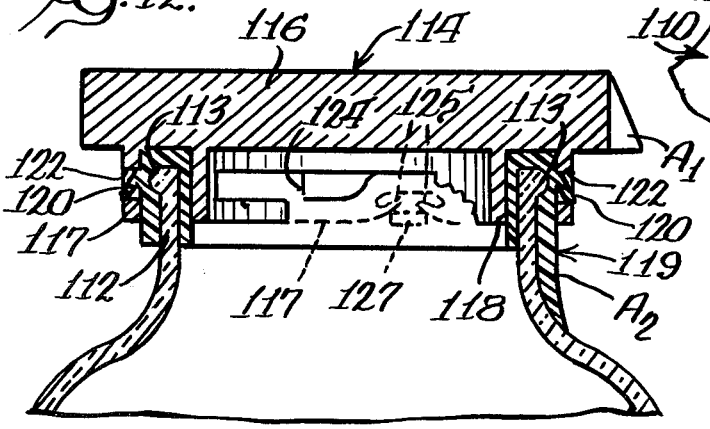
FIG. 12 is a view taken generally along lines 12—12 of FIG. 11.

FIGS. 11 and 12 illustrate a container 110, such as a jar or the like, including a neck portion 112 defining an open mouth, with a thread formation 113 on the neck portion 112. Such a thread formation is usually provided on a container for coaction with an associated threaded closure.

In this embodiment, a closure 114 is provided, including a top wall portion 116 and first and second, generally concentric annular skirt portions 117 and 118 depending from top wall portion 116.

In order to permit the present tamper-indicating arrangement to be used on a container such as 110, an annular adapter member 119 is provided which is adapted to fit on neck portion 112 generally about the open mouth of the container. In this illustrated embodiment, adapter member 119 is adapted to be pressed, threaded, or otherwise fitted to neck portion 112 of container 110. Adapter member 119 is preferably secured against rotation on container 110 such as by swaging, shrink-fitting, interference fitting, or like deforming of the adapter member so that it closely fits and coacts with thread formation 113. Naturally, the manner in which adapter member 119 is secured to a container such as 110 to substantially prevent rotation therebetween will depend upon the configuration of such a container, as well as the configuration of the adapter member.

This embodiment of the present invention is intended to function in a manner similar to that of the above-described embodiment. A first coacting arrangement is provided for retaining closure 114 on container 110, and comprises one or more first projections on one of the closure 114 and the adapter member 119, and one or more first openings defined by the other of the closure and the adapter member. Specifically, first locking projections 120 are provided on the outwardly facing surface of adapter member 119, with projections 120 being receivable within first openings 122 defined by the first skirt portion 117 of closure 114. First projections 120 are adapted to cooperate with first openings 122 for retaining closure 114 on container 110 in a first position with respect thereto. First projections 120 and first openings 122 are preferably configured to permit closure 114 to be initially applied by generally axial movement onto container 112, such as by press-fitting. To this end, projections 120 are illustrated as being undercut to provide them with a hinge-like action about their upper portions to facilitate their correct positioning within openings 122 (see FIG. 12).

In this embodiment, a second coacting arrangement is provided by one or more projections on one of closure 114 and adapter member 119, with one or more respective openings provided on the other of the closure and adapter member. To this end, second locking projections 124 are provided on the inwardly facing surface of adapter member 119, with second projections 124 being adapted to be received within second openings 126 defined by the second skirt portion 118 of closure 114. It will be noted that second openings 26 are generally configured as open-ended slots, and are adapted to receive second projections 124 by generally axial movement of closure 114 onto container 110, followed by relative rotation of the closure and the container. As with the previously described embodiment, second projections 124 cooperate with second openings 126 to retain closure 114 on container 110 in a second position which is reoriented from the first position of the closure with respect to the container.

In this embodiment, biasing means are provided for preventing closure 140 from fully seating on adapter member 119 on container 110 in the first position of the closure after fracture of first projections 120. The biasing means include resiliently flexible biasing tabs 125 defined by first skirt portion 117 of the closure, which are adapted to biasingly engage and coact with an abutment 127 on the outer surface of adapter member 119. When closure 114 is initially applied to container 110, the closure is fully seated and retained in its first position on the container by coaction of first projections 120 with first openings 122 in opposition to biasing tabs 125 (see FIG. 12). After closure 114 is initially removed by fracture of first projections 120, the biasing action of tabs 125 against abutment 127 prevents the closure from fully seating again it in its first position on the container, thus providing a visual indication of opening.

After closure 114 has been initially applied to container 110, the closure can be removed by relative rotation with respect to the container and adapter member 119, resulting in fracture of first projections 120. To assure proper function, first projections 120 are preferably configured so that the force required for their failure is substantially less than the force required to relatively rotate adapter member 119 and container 110.

Figure 13:
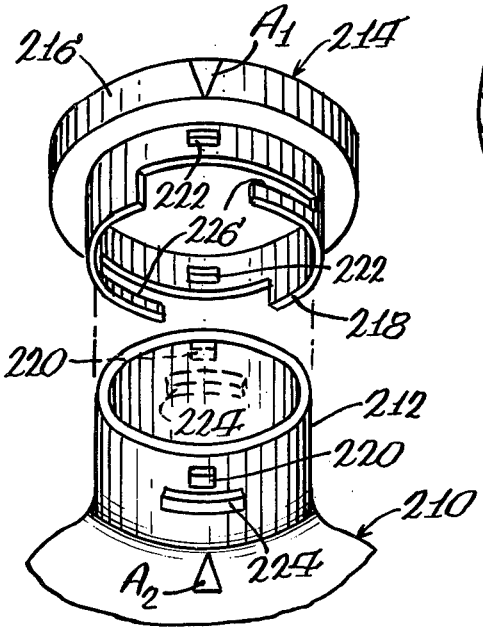
FIG. 13 is a perspective view of another alternate embodiment of the present invention.

A further embodiment of the present invention is illustrated in FIG. 13, with the reference numerals in this figures indicating the correspondence of the various elements to the previous described embodiments. Essentially, this embodiment functions in the same manner as the embodiment of FIGS. 1–10, with first locking projections 220 and second locking projection 224 being provided on the outwardly facing surface of neck portion 212 of container 210. Projections 220 are respectively receivable within first openings 222 defined by skirt portion 218 of closure 214 for retaining the closure on the container in a first position. Projections 220 are fracturable attendant to relative rotation of the closure on the container, with second locking projections 224 being receivable within second openings 226 defined by skirt portion 218 for retaining closure 214 on the container in a second reoriented position.

A further embodiment of the present invention is illustrated in FIGS. 14–17, with the reference numerals in these figure indicating the correspondence of various elements to the previous described embodiments. This embodiment functions in essentially the same manner as the previously described embodiments, and includes first and second coacting arrangements for retaining the closure on the associated container in two distinct positions.

Figure 14:
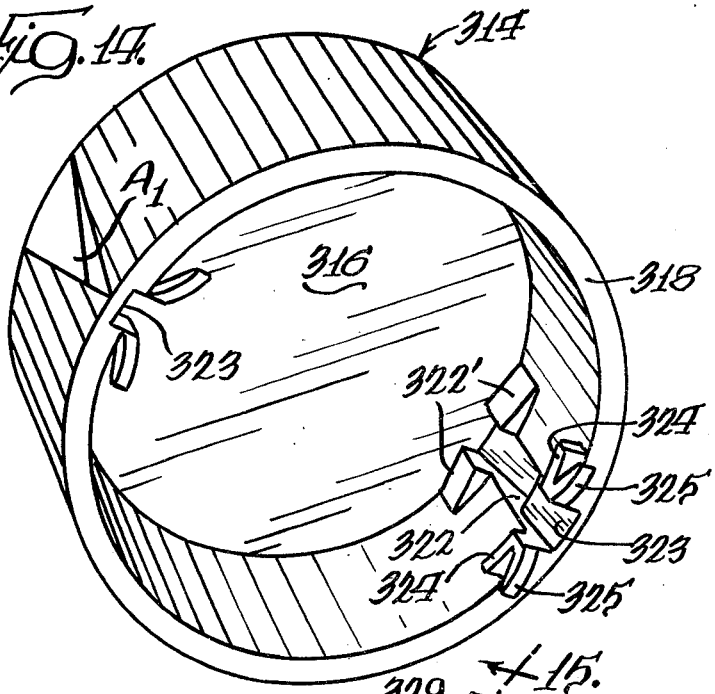
FIG. 14 is a perspective view of a further embodiment of the present invention.
Figure 14:
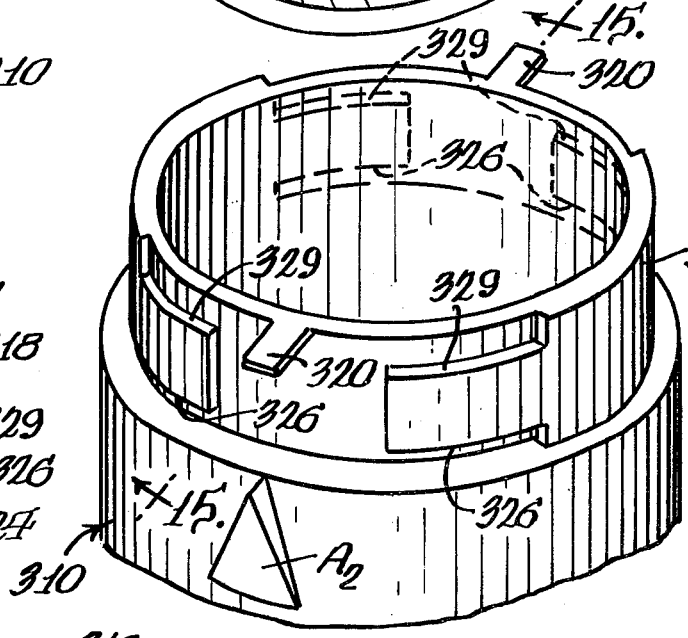
Figure 16:
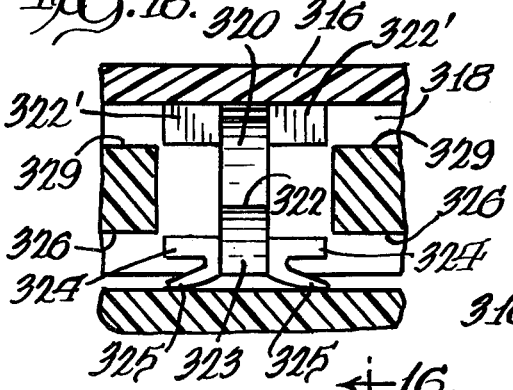
FIG. 16 is a view taken generally along lines 16—16 of FIG. 15.
Figure 15:
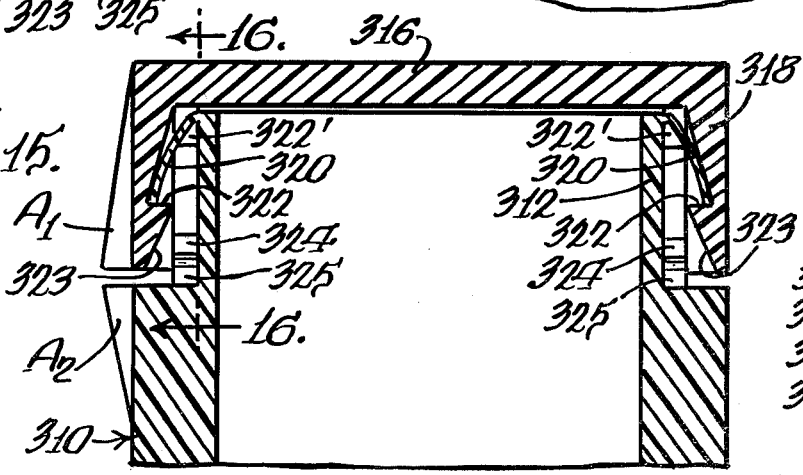
FIG. 15 is a view taken generally along lines 15—15 of FIG. 14.

Accordingly, FIGS. 14–16 illustrate a container 310 including a neck portion 312 defining an open mouth. Closure 314 is adapted to fit on container 310 to close the mouth thereof, and includes a top wall portion 316 and a depending skirt portion 318.

In accordance with the present invention, a first coacting arrangement is provided on the closure 314 and the container 310 for retaining the closure on the container in a first position with respect thereto. Specifically, container 310 includes fracturable, first locking projections 320 which are adapted to be respectively received within first openings 322 defined by skirt portion 318 of closure 314 attendant to press-fitting. Cam surfaces 323 can be provided on skirt portion 318 to facilitate positioning of first projections 320 in first openings 322, with the first projections 320 exhibiting sufficient resilient flexibility to fit within first openings 322 and retain closure 314 on container 310 in a first position with respect thereto.

In a manner similar to the above-described embodiments, first projections 320 are intended to fracture attendant to initial opening of container 310. In this embodiment, a pair of shear bosses 322' are provided on opposite sides of each of first openings 322. Shear bosses 322' are adapted to engage first projections 320 attendant to relative rotation of the closure and the container when the container is initially opened to facilitate shearing of first projection 320. This configuration facilitates initial opening of the container by relative rotation of closure 314 in either direction.

In order to permit closure 314 to be reapplied to container 310 and retained thereon in a second, reoriented position, second locking projections 324 are provided on the inside surface of skirt portion 318 of closure 314. In this embodiment, a pair of second projections 324 are provided on respective opposite sides of the cam surfaces 323 provided on closure 314. Second projections 324 are adapted to be received within second openings 326 defined by the neck portion 312 of container 310. Each opening 326 is configured generally as an open-ended slot, with each opening 326 being adapted to receive and retain a respective pair of second projections 324 when closure 314 is moved generally axially onto container 310 and relatively rotated. As will be appreciated, the configuration of second openings 326 in this embodiment permits closure 314 to be reapplied to container 310 by generally axial movement of the closure onto the container, followed by relative rotation of the closure and the container in either direction. To facilitate reapplication of the closure to the container in this manner, slot-like openings 329 are provided for receiving shear bosses 322' when the closure 314 is reapplied to container 310 in its second, reoriented position.

After initial opening of the container attendant to fracture of first projections 320, closure 314 can no longer be retained in its first position on container 310. In order to provide a visual indication that the container has been opened, this embodiment of the present invention includes spring tabs 325 which engage container 310, and prevent closure 314 from fully seating on the container in its first position after first projections 320 have fractured. In this embodiment, spring tabs 325 are illustrated as formed integrally with second locking projections 324. When closure 314 is reapplied to container 310 after its initial opening, spring tabs 325 resiliently deform, and are adapted to fit within second openings 326 (with projections 324) when closure 314 is reapplied to container 310 in its second, reoriented position.

Figure 17:
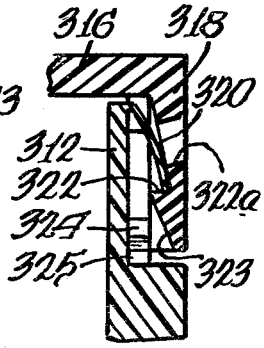
FIG. 17 is fragmentary view similar to FIG. 15 illustrating a modification of the embodiment shown in FIGS. 13-16.

As noted previously, embodiments of the present invention wherein the first openings adapted to receive first locking projections are defined by a skirt portion of the closure of the arrangement may be configured such that the first openings do or do not extend through the skirt portion of the closure. Thus, in the embodiment illustrated in FIGS. 14–16, first openings 322 are illustrated as not extending through skirt portion 318. FIG. 17 illustrates a modication wherein first openings 322 each include a portion 322*o* which extends through skirt portion 318, thus facilitating visual inspection of first locking projections 320 within first openings 322 before closure 314 is initially removed from container 310. By suitable coloring of first projections 320, their presence or absence can be more easily visually discerned.

Thus, a tamper-indicating arrangement for a container is disclosed which is straightforward in construction for economical manufacture, and which reliably indicates initial opening of a container in a manner which facilitates convenient use of the arrangement. Additionally, the arrangement can be readily retrofitted for use with existing container constructions.

From the foregoing, it will be observed that numerous variations and modifications may be effected without departing from the true spirit and scope of the concept of the present invention. It will be understood that no limitation with respect to the specific embodiments illustrated herein is intended or should be inferred. It is, of course, intended to cover by the appended claims all such modifications as fall within the scope of the claims.

What is claimed is:

1. A tamper-indicating arrangement for a container having a neck portion defining an open mouth comprising:

a closure adapted to close said mouth;

coacting means on said closure and said container for permitting said closure to be applied to said container and retained in place thereon in a first position with respect to said container, and for permitting said closure to be reapplied to said container after removal therefrom, and retained on said container in a second position with respect to said container; and indicating means for visually indicating reorientation of said closure from said first position to said second position with respect to said container.

2. The tamper-indicating arrangement in accordance with claim 1, wherein said coacting means includes fracturable means which fracture when said closure is first moved from its first position after said closure is initially applied to said container.

3. The tamper-indicating arrangement in accordance with claim 2, wherein said coacting means permits said closure to be moved generally axially onto said container and retained thereon in said first position when said closure is initially applied to said container, said fracturable means being adapted to fracture attendant to relative rotation of said closure and container for removal of said closure from said container.

4. The tamper-indicating arrangement in accordance to claim 1, including biasing means on one of said closure and said container, said biasing means acting to prevent said closure from fully seating on said container in said first position after initial removal of said closure from said container.

5. The tamper-indicating arrangement in accordance with claim 1, wherein said coacting means comprises first coacting means on said closure and said container for retaining said closure in said first position, and second coacting means on said closure and said container for retaining said closure in said second position.

6. The tamper-indicating arrangement in accordance with claim 5, wherein said first coacting means comprises first projection means on one of said neck portion and said closure, and first opening means defined by the other of said neck portion and said closure, said first opening means being adapted to receive said first projection means when said closure is in said first position on said container for retaining said closure on said container.

7. The tamper-indicating arrangement in accordance with claim 6, wherein said first projection means comprises fracturable means adapted to fracture when said closure is moved from said first position.

8. The tamper-indicating arrangement in accordance with claim 6, wherein said second coacting means comprises second projection means on one of said neck portion and said closure, and second opening means defined by the other of said neck portion and said closure, said second opening means being adapted to receive said second projection means when said closure is in said second position on said container for retaining said closure on said container.

9. The tamper-indicating arrangement in accordance with claim 8, wherein said second projection means is receivable within said second opening means by moving said closure generally axially onto said container, and relatively rotating said closure and container to move said closure to said second position.

10. The tamper-indicating arrangement in accordance with claim 8, wherein said first and second coacting means on said container are provided by annular means adapted to fit on the neck portion of the container generally about said open mount.

11. A tamper-indicating arrangement for a container having a neck portion defining an open mouth, comprising a closure adapted to close said open mouth;

first coacting means on said closure and said container for permitting said closure to be initially applied to said container by generally axial movement of said closure onto said container, said first coacting means being adapted to retain said closure on said container in a first position with respect thereto, said first coacting means including fracturable means adapted to fracture when said closure is first removed from said container;

second coacting means on said closure and said container for permitting said closure to be reapplied to said container after removal therefrom, and retained on said container in a second position with respect to said container.

12. A tamper-indicating arrangement in accordance with claim 11, including indicating means for visually indicating reorientation of said closure from said first position to said second position with respect to said container.

13. A tamper-indicating arrangement in accordance with claim 11, wherein said first coacting means comprises first projection means on said container which provides said fracturable means, and first opening means defined by said closure adapted to receive said first projection means in the first position of said closure with respect to said container.

14. A tamper-indicating arrangement in accordance with claim 13, wherein said second coacting means comprises second projection means on said container, and second opening means defined by said closure adapted to receive said second projection means in the second position of said closure with respect to said container.

15. A tamper-indicating arrangement in accordance with claim 14, wherein said closure includes a top wall portion and a depending skirt portion, said first and second opening means being defined by said skirt portion, said second opening means comprising open-ended slot means whereby said second projection means is receivable in said slot means by moving said closure generally axially onto said container and then relatively rotating said container and said closure to position said closure in said second position.

16. A tamper-indicating arrangement in accordance with claim 14, wherein said closure includes a top wall portion and first and second depending skirt portions, said first skirt portion defining said first opening means, and said second skirt portion defining said second opening means.

17. A tamper-indicating arrangement in accordance with claim 14, wherein said first and second projection means projects from an annular adapter adapted to fit on the neck portion of said container generally about the mouth thereof.

18. A tamper-indicating arrangement in accordance with claim 13, wherein said closure includes a top wall portion, and a depending skirt portion defining said first opening means;

said second coacting means comprising second projection means on the inside surface of said skirt portion, said second opening means being defined by the outwardly facing surface of said neck portion of said container, said second opening means being adapted to receive said second projection means by generally axial movement of said closure onto said container followed by relative rotation of said closure and said container.

19. A tamper-indicating arrangement in accordance with claim 11, including means for biasing said closure from said container on one of said closure and said container, said biasing means acting to prevent said closure from fully seating on said container in said first position after fracture of said fracturable means to visually indicating opening of said container.

* * * * *